US010987606B2

(12) United States Patent
Lunde et al.

(10) Patent No.: US 10,987,606 B2
(45) Date of Patent: Apr. 27, 2021

(54) SIMULATED AFTERBURNER FLAME EFFECT

(71) Applicant: Technifex Products, LLC, Valenica, CA (US)

(72) Inventors: Montgomery C. Lunde, Marina del Rey, CA (US); Rockne J. Hall, Newhall, CA (US); Ryan G. Lunde, Santa Clarita, CA (US); Matthew A. Case, Sylmar, CA (US)

(73) Assignee: Technifex Products, LLC, Valencia, CA (US)

( * ) Notice: Subject to any disclaimer, the term of this patent is extended or adjusted under 35 U.S.C. 154(b) by 256 days.

(21) Appl. No.: 16/189,061

(22) Filed: Nov. 13, 2018

(65) Prior Publication Data

US 2019/0143239 A1 May 16, 2019

Related U.S. Application Data

(60) Provisional application No. 62/585,486, filed on Nov. 13, 2017.

(51) Int. Cl.

| | |
|---|---|
| ***A63J 5/02*** | (2006.01) |
| ***A63J 25/00*** | (2009.01) |
| ***F21S 10/04*** | (2006.01) |
| ***F17C 7/04*** | (2006.01) |

(52) U.S. Cl.

CPC ..... *A63J 5/025* (2013.01); *A63J 5/023* (2013.01); *A63J 25/00* (2013.01); *F17C 7/04* (2013.01); *F21S 10/04* (2013.01)

(58) Field of Classification Search

None

See application file for complete search history.

(56) References Cited

U.S. PATENT DOCUMENTS

| | | | | |
|---|---|---|---|---|
| 643,493 | A | 2/1900 | Fuller | |
| 3,044,301 | A * | 7/1962 | Bennett | B64G 7/00 73/865.6 |
| 3,334,816 | A * | 8/1967 | Mizuno | B05B 17/08 239/18 |
| 3,432,439 | A | 3/1969 | Dickman | |
| 4,002,333 | A | 1/1977 | Gotoh | |
| 4,026,544 | A | 5/1977 | Plambeck et al. | |
| 4,426,021 | A | 1/1984 | Rosenthal | |
| 4,568,288 | A * | 2/1986 | Patteson | G09B 25/02 434/219 |

(Continued)

FOREIGN PATENT DOCUMENTS

DE 3921407 A1 1/1991

*Primary Examiner* — Thor S Campbell

(74) *Attorney, Agent, or Firm* — James A. Sheridan; Sheridan Law, LLC

(57) ABSTRACT

The invention is directed to special effect device that is used to produce a simulated flame that has the shape and, if desired, the color characteristics of the flame produced by a jet afterburner. In one embodiment, the device includes a steam system for providing a stream of steam, a steam accelerator for applying a high-speed and highly linear stream of air to steam provided by the steam system to produce at steam cloud with a highly linear shape similar to the shape of the flame produced by a jet afterburner, and a lighting system to project desired colors onto the linear steam cloud.

13 Claims, 6 Drawing Sheets

(56) References Cited

U.S. PATENT DOCUMENTS 4,907,330 A * 3/1990 Akao ..... F02B 19/165 123/90.51
4,994,092 A 2/1991 Eklund et al.
5,156,333 A 10/1992 Worsfold
5,407,392 A 4/1995 Laijoki-Puska
5,790,013 A 8/1998 Hauck
5,882,717 A * 3/1999 Panesar ..... A23F 5/40 426/595
5,989,128 A 11/1999 Baker et al.
6,363,636 B1 4/2002 Hess et al.
6,685,574 B2 2/2004 Hall
6,802,782 B2 10/2004 Hall et al.
6,953,401 B2 10/2005 Starr
7,300,179 B1 11/2007 LaDuke et al.
7,641,361 B2 1/2010 Wedell et al.
7,686,471 B2 3/2010 Reichow
7,762,897 B2 7/2010 Starr et al.
7,837,355 B2 11/2010 Schnuckle
7,850,533 B2 12/2010 Osterman et al.
8,028,438 B2 10/2011 Pedtke
8,070,319 B2 12/2011 Schnuckle et al.
8,342,712 B2 1/2013 Patton et al.
8,523,692 B2 9/2013 Osterman et al.
8,534,869 B2 9/2013 Patton et al.
8,550,660 B2 10/2013 Patton et al.
8,646,946 B2 2/2014 Schnuckle et al.
8,696,166 B2 4/2014 Patton et al.
8,721,118 B2 5/2014 Patton et al.
8,727,569 B2 5/2014 Schnuckle et al.
8,800,933 B2 8/2014 Dunn
9,068,706 B2 6/2015 Fournier et al.
9,366,402 B2 6/2016 Li
9,371,973 B2 6/2016 Li
9,384,673 B1 7/2016 Jahnke
9,447,937 B2 9/2016 Fournier et al.
9,447,938 B2 9/2016 Li
9,512,971 B2 12/2016 Li
9,518,710 B2 12/2016 Li
9,523,471 B2 12/2016 Li
9,551,470 B2 1/2017 Li
9,585,980 B1 3/2017 Li
9,605,824 B1 3/2017 Li
9,625,112 B2 4/2017 Li
9,689,538 B2 6/2017 Hau et al.
9,689,544 B2 * 6/2017 Green, Jr. ..... H05B 45/10
9,709,231 B2 7/2017 Li
9,739,432 B2 8/2017 Li
9,810,388 B1 11/2017 Li
9,949,346 B2 4/2018 Patton
10,010,640 B1 7/2018 Li
10,018,313 B2 7/2018 Schnuckle et al.
10,018,362 B1 * 7/2018 Swanson ..... F24B 1/183
10,024,507 B2 7/2018 Fournier et al.
10,060,585 B2 8/2018 Li
10,111,307 B2 10/2018 Li
10,112,203 B2 * 10/2018 Kubicek ..... A61L 9/122
10,125,937 B2 11/2018 Green, Jr. et al.
10,145,562 B1 * 12/2018 Swanson ..... F24C 7/004
10,675,553 B1 * 6/2020 Witt ..... A63J 5/02
2003/0190966 A1 * 10/2003 Hall ..... A63J 5/023 472/65
2004/0077416 A1 * 4/2004 Hall ..... A63J 5/023 472/57
2005/0101393 A1 * 5/2005 Starr ..... A63J 5/023 472/65
2006/0275721 A1 * 12/2006 Starr ..... G09F 19/12 431/125
2008/0112154 A1 5/2008 Reichow
2008/0146358 A1 6/2008 Osterman et al.
2008/0291663 A1 * 11/2008 Wedell ..... F21V 19/0055 362/147
2010/0031543 A1 2/2010 Rice et al.
2011/0019422 A1 1/2011 Schnuckle et al.
2011/0045302 A1 2/2011 Osterman et al.
2011/0127914 A1 6/2011 Patton et al.
2014/0168946 A1 * 6/2014 Kaplan ..... A63J 5/025 362/96
2015/0338086 A1 11/2015 Patton

* cited by examiner 82
70
88
90
84

84
82
70
78
76
82
70
84

70
124
37.5±
92
124
84
Ø25.25
A
84
A
78
82

70

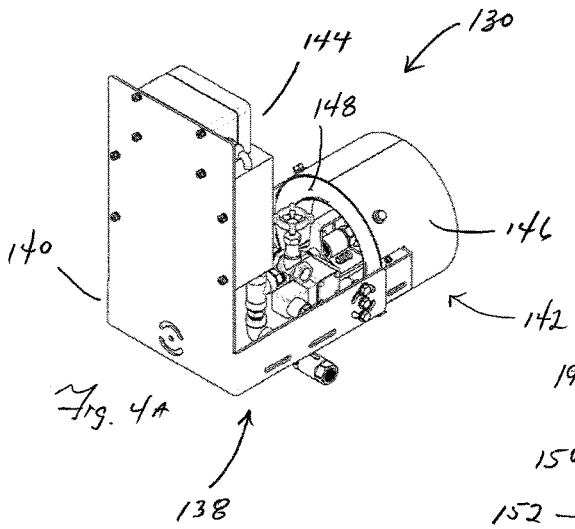
Fig. 4A
Fig. 4B
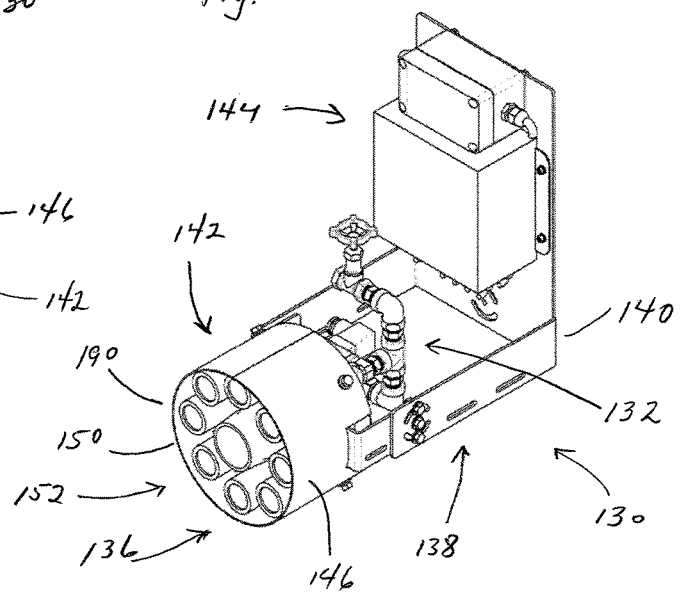
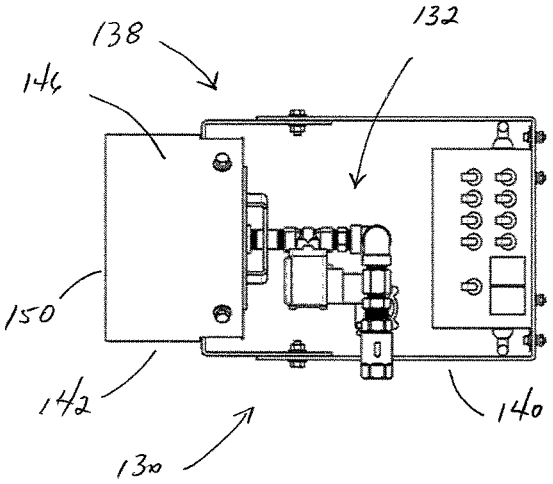
Fig. 5A
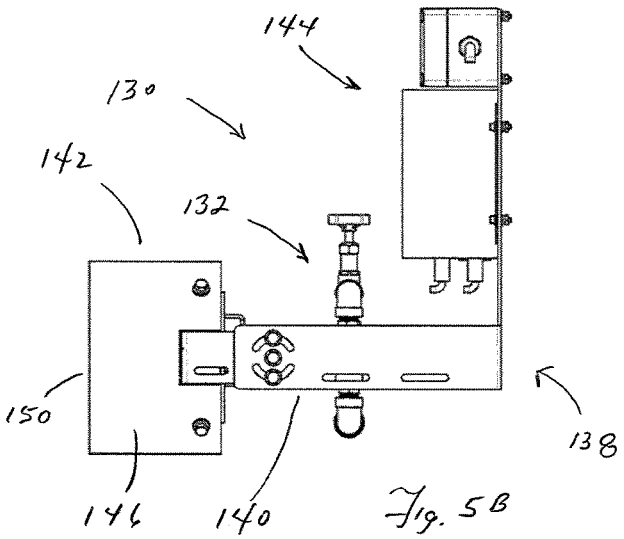
Fig. 5B
Fig. 5C
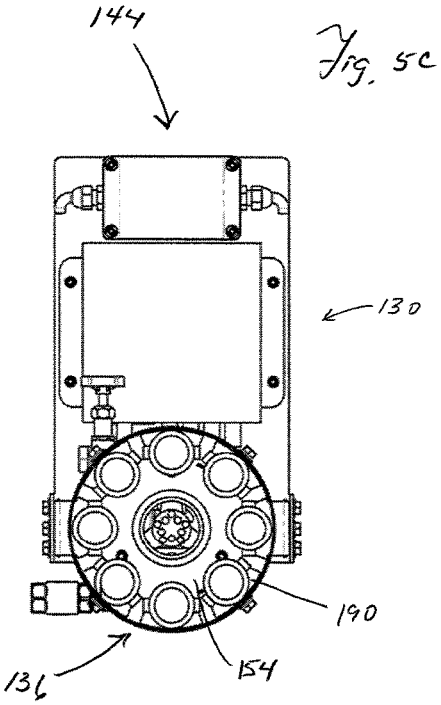

Fig. 6
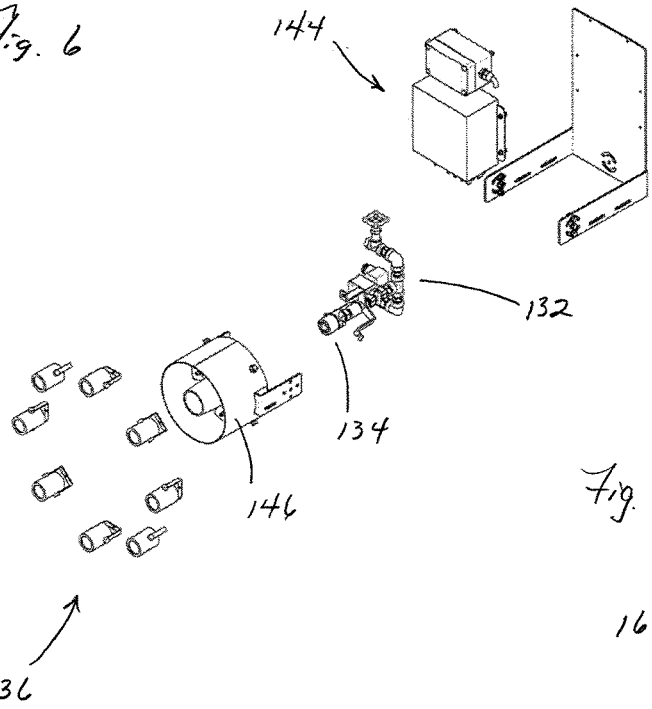
Fig. 7
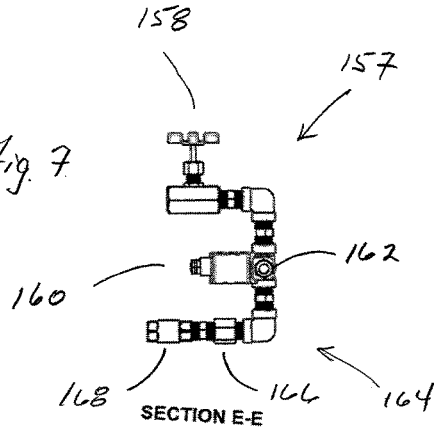
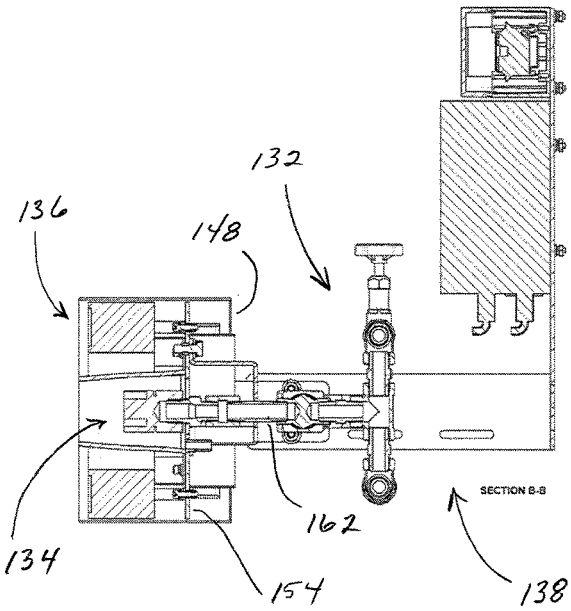
Fig. 8
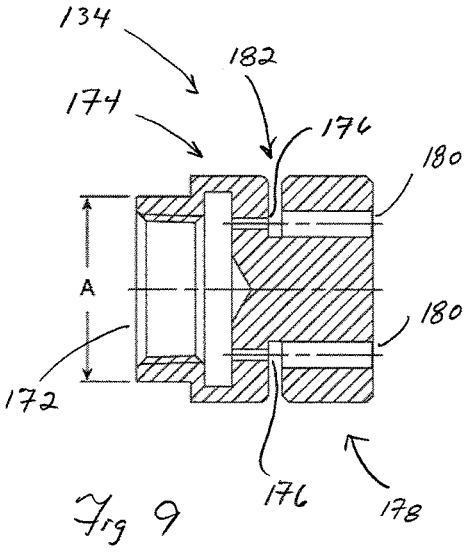
Fig 9

Fig. 10
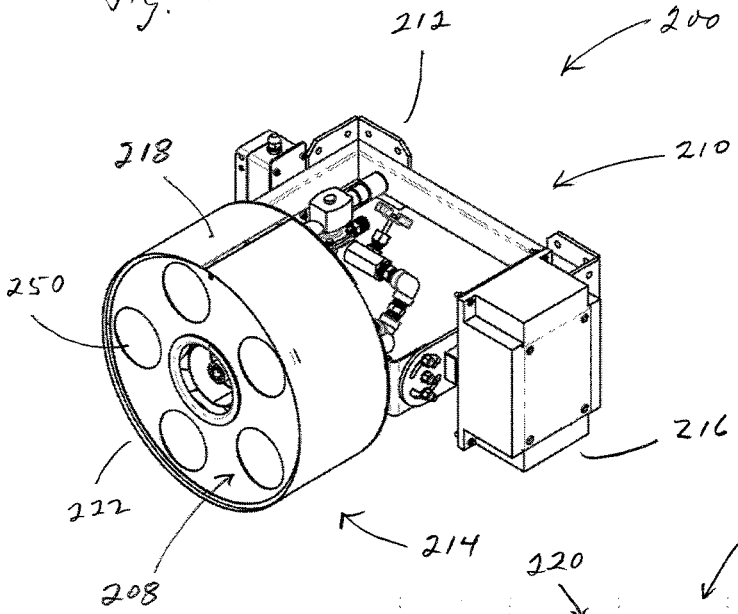
Fig. 11A
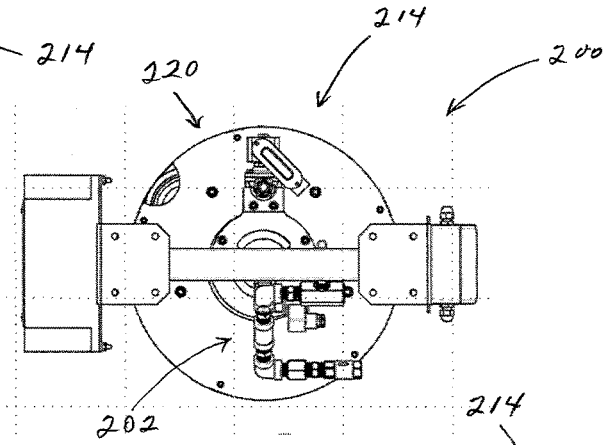
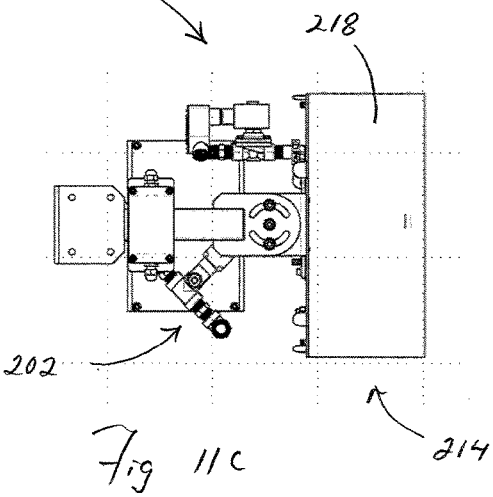
Fig 11C
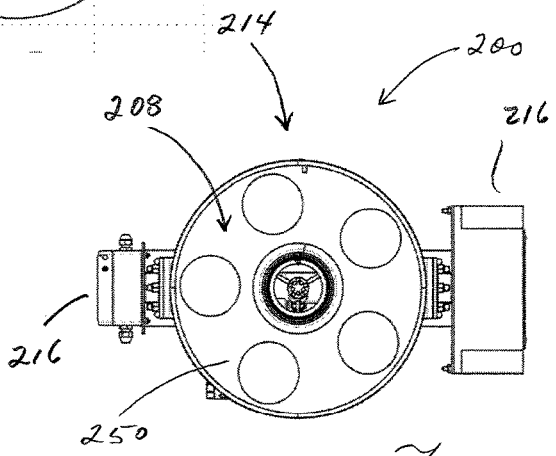
Fig. 11B

Fig. 12
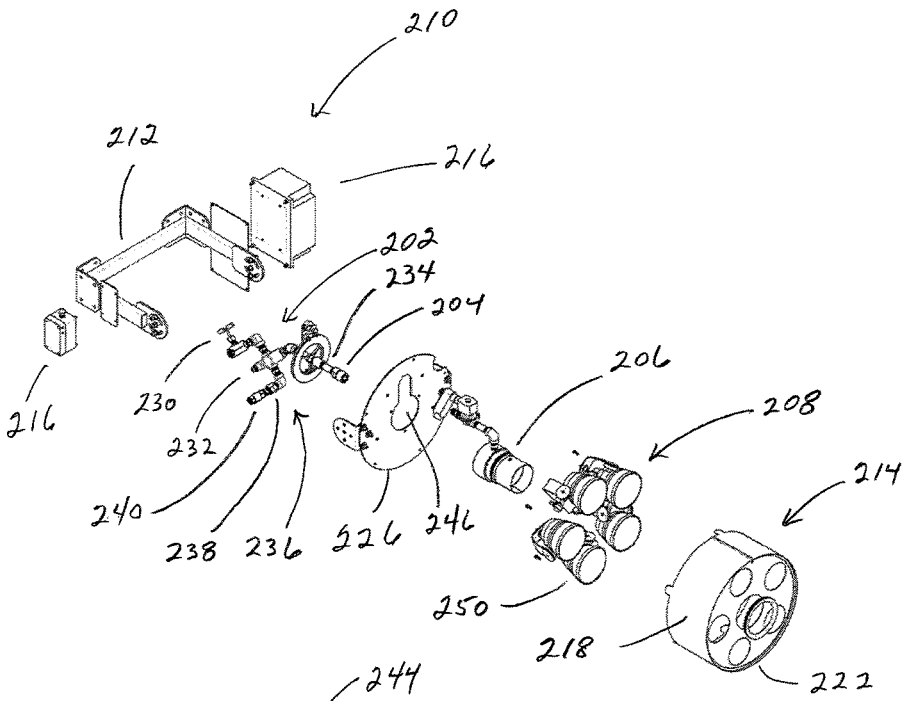
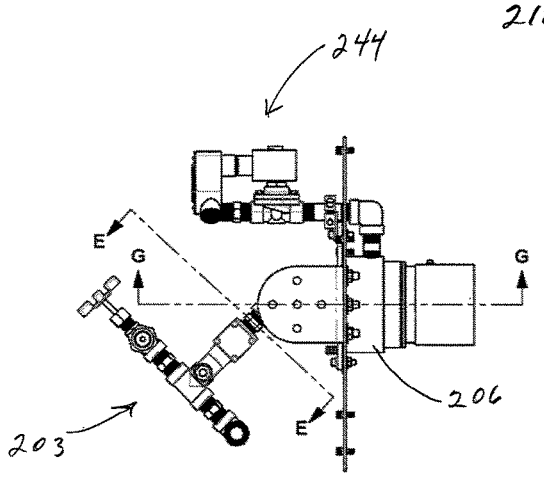
Fig. 13A
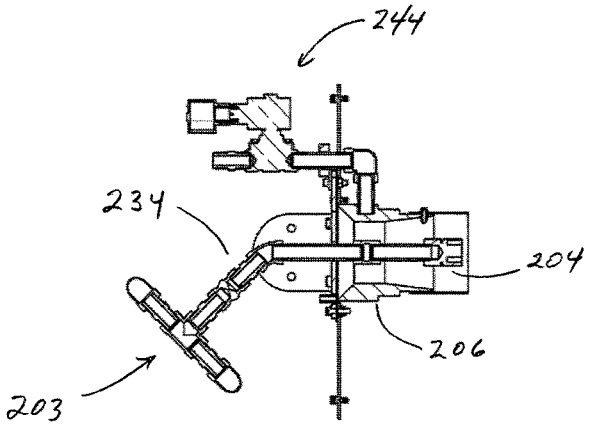
SECTION F-F
Fig 13B

SIMULATED AFTERBURNER FLAME EFFECT

CROSS REFERENCE TO RELATED APPLICATIONS

This application claims the benefit of U.S. provisional patent application No. 62/585,486, entitled "Simulated Fire Effect Using Steam" and filed on Nov. 13, 2017, which application is incorporated by reference into this application in its entirety.

FIELD OF THE INVENTION

The present invention is directed to a special effect device and, more specifically, to a special effect for producing a particular type of simulated flame or fire effect, namely, an "afterburner" flame effect.

BACKGROUND OF THE INVENTION

The use of a simulated fire or flame is desirable in many applications. For instance, in many theme park attractions (e.g., volcano, battle scene and disaster scenes), the use of a simulated flame or fire is preferred relative to a real flame or fire for a number of reasons. For instance, a real flame or fire must typically be located a substantial distance from an audience to prevent members of the audience from coming into contact with the fire or flame. Further, with respect to attractions that are located indoors, a real flame or fire produces heat and smoke that typically require additional air conditioning and ventilation. In contrast, several types of simulated flame or fire effects can be located close to an audience and do not typically impose the air conditioning and ventilation requirements of a real flame or fire.

There are many types of devices for producing simulated flames or fire. For example, one type of device blows strips of colored material, such as silk, up into the air and shines an appropriately colored light onto the strips. From a distance, these devices provide a reasonably convincing simulated flame or fire. At the other end of the spectrum are devices that provide a television or video monitor with a signal of a pre-recorded fire or flame. Such devices are impractical in theme park applications that require a flame or fire that extends over a distance that is greater than the typical width and height of a video monitor or television. Yet a further type of device involves the use of a screen of atomized water and the projection of an image or light on the screen that creates the illusion of a flame or fire. Also known are devices that use theatrical smoke or steam in creating the illusion of a fire or flame. Among these devices are the devices disclosed in U.S. Pat. Nos. 6,685,574, 6,802,782, 6,953,401, and 7,762,897.

SUMMARY OF THE INVENTION

The invention disclosed herein is directed to an apparatus for producing a simulated "afterburner" flame effect using steam. To elaborate, an afterburner flame is the flame output by, for example, the jet engine of a fighter airplane. Characteristic of an afterburner flame is that the flame has a linear character and, as such, has columnar shape or a very steep conical shape that changes relatively little over time. In contrast, the flame produced by a candle or in a fireplace has a non-linear character that varies over time.

In a particular embodiment, the apparatus includes a pipe for conveying a stream of steam, a steam accelerator for accelerating the stream of steam provided at the outlet of the pipe so that the stream of steam takes on the highly linear characteristic of an afterburner flame, and a lighting structure adapted to project the desired color or colors of light onto the accelerated stream of steam. Generally, to simulate the flame produced by the afterburner of a jet engine, the colors projected onto the accelerated stream of steam are blue, red, and yellow. However, other colors can be projected.

In one embodiment, the steam accelerator includes a nozzle that is adapted to receive a steam of steam provided by the pipe and use the Venturi effect to create a vacuum that pulls ambient air into the nozzle to accelerate the stream of steam. In a particular embodiment, the nozzle is a sparging nozzle that is designed to inject a gas into a liquid. The structure of such a sparging nozzle also facilitates the application of an accelerated stream of air to a stream of steam to accelerate the stream of steam and thereby produce the highly linear characteristic associated with an afterburner flame.

In another embodiment, the steam accelerator employs an air amplifier to apply an accelerated stream of air to the stream of steam provided by the pipe. Such a steam accelerator exploits what is known as the Coanda effect to produce an accelerated stream of air.

Yet another embodiment of the apparatus is capable of producing a relatively long simulated afterburner flame. To achieve such a simulated afterburner flame, the apparatus employs a two-stage steam accelerator. The first stage of the steam accelerator is a nozzle that employs the Venturi effect to accelerate the stream of steam provided by the pipe to produce stream of steam with the highly linear characteristic of an afterburner flame. In this regard, the greater the steam pressure associated with the stream of steam that is applied to the nozzle, the greater the length of the accelerated stream of steam. The second stage of the steam accelerator is realized with an air amplifier that is positioned so that the accelerated stream of steam produced by the first stage is within the footprint of the stream of air produced by the air amplifier. It is believed that the stream of air produced by the air amplifier acts as a cage to prevent the stream of steam produced by the nozzle for bending or billowing and becoming unlike an afterburner flame. The stream of air produced by the air amplifier is believed to contribute to accelerating the steam cloud output by the nozzle.

In yet another embodiment, a sintered nozzle receives the stream of steam from the pipe and produces a relatively evenly distribute cloud of steam. An air amplifier is used to accelerate the cloud of steam so as to produce a steam cloud with the desired, highly linear characteristic.

BRIEF DESCRIPTION OF THE DRAWINGS

FIGS. 4A and 4B are perspective views of a second embodiment of a special effect device for producing a simulated afterburner effect;

FIGS. 5A-5C respectively are bottom, side, and front-end views of the special effect device shown in FIGS. 4A and 4B;

FIG. 6 is an exploded view of the special effect device shown in FIGS. 4A and 4B;

FIG. 7 is a view of the pipe structure used to provide the steam used in the special effect device shown in FIGS. 4A and 4B;

FIG. 8 is a cross-sectional view of the special effect device shown in FIGS. 4A and 4B;

FIG. 9 is a cross-sectional view of the nozzle used to produce an accelerated stream of steam in the special effect device shown in FIGS. 4A and 4B;

FIG. 10 is a perspective view of a third embodiment of a special effect device for producing a simulated afterburner effect;

FIGS. 11A-11C respectively are rear, side, and front-end views of the special effect device shown in FIG. 10;

FIG. 12 is an exploded view of the special effect device shown in FIG. 10; and FIGS. 13A and 13B respectively are a plan view and a cross-sectional view of the two-stage steam accelerator employed in the special effect device shown in FIG. 10.

DETAILED DESCRIPTION

Figures 1A, 1B, 2A, 2B, 2C:
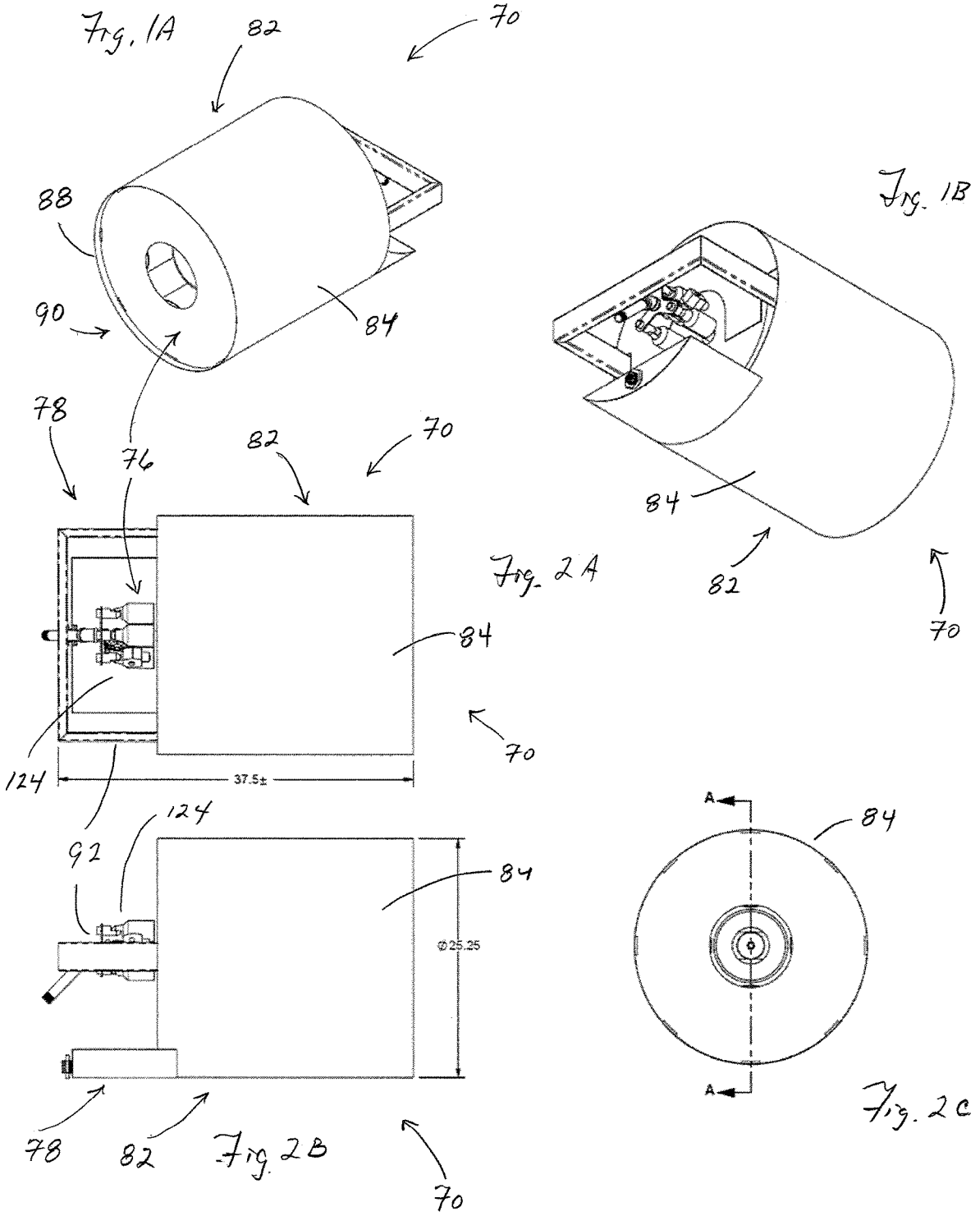
FIGS. 1A and 1B are perspective views of a first embodiment of a special effect device for producing a simulated afterburner effect.
FIGS. 2A-2C respectively are top, side, and front-end views of the special effect device shown in FIGS. 1A and 1B.
Figure 3:
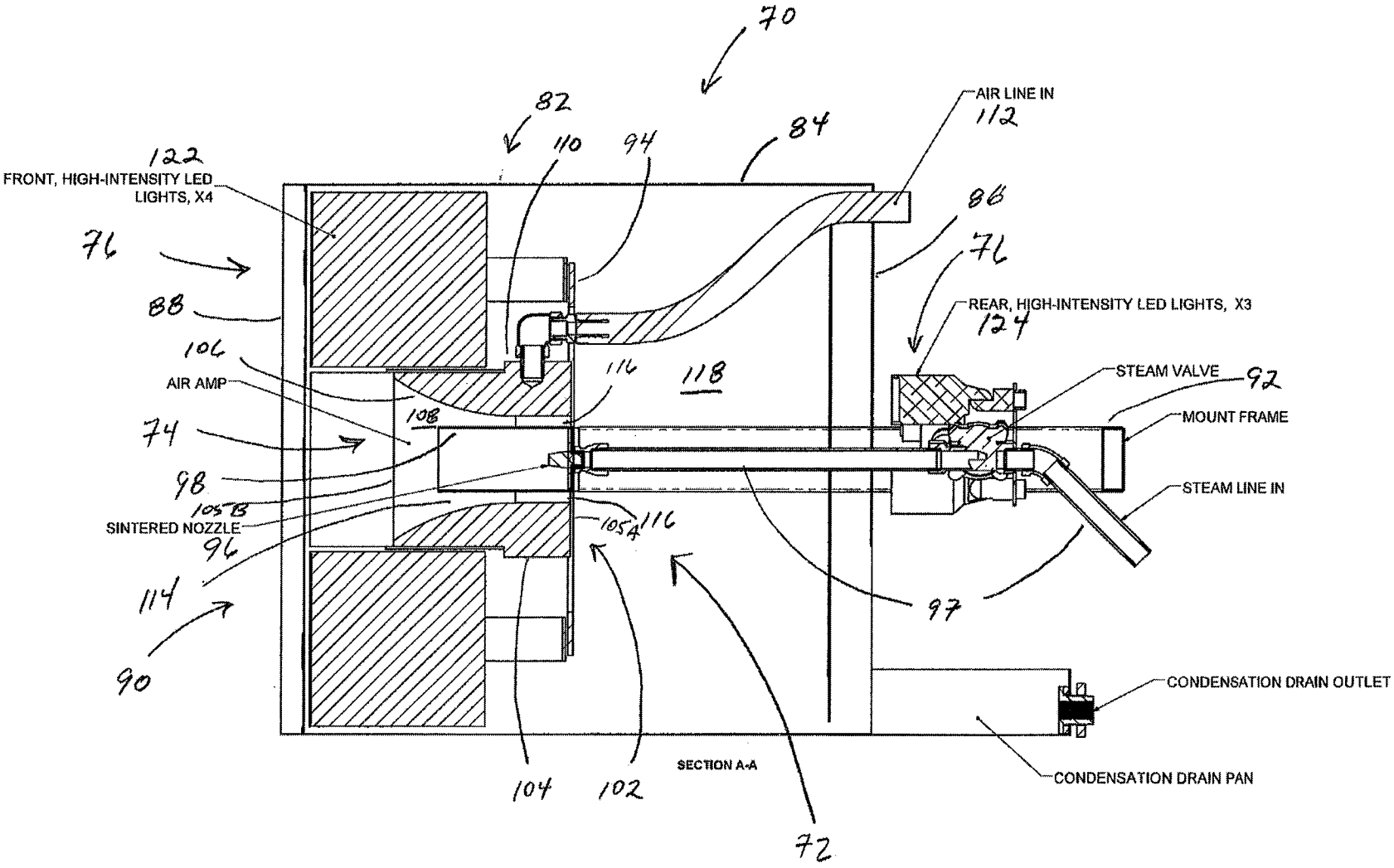
FIG. 3 is cross-sectional view of the special effect device shown in FIGS. 1A and 1B.

With reference to FIGS. 1A, 1B, 2A-2C, and 3, a first embodiment of a special effect device 70, which is hereinafter referred to as device 70, that uses steam to produce a simulated fire or flame effect is described. The fire or flame effect that device 70 is typically used to produce is not the kind of flame or fire produced by a candle or campfire. Rather, the device 70 is typically used to produce a simulated flame that is similar to the flame produced by a jet engine on a fighter aircraft when using its afterburners. Generally, the device 70 includes a steam cloud system 72 for producing a cloud of steam, an air amplifier 74 for producing a high-velocity and substantially linear flow of air, a lighting system 76 for producing light that is directed onto a linearly extending steam cloud produced by the operation of the steam cloud system 72 and the air amplifier 74 so that the resulting simulated flame has the color or colors of an actual flame, and a housing 78 for supporting the system 72, amplifier 74, and lighting system 76. In operation, the steam cloud system 72 produces a steam cloud. The air amplifier 76 operates (typically) to produce a high-speed and substantially linear stream of air that transforms the steam cloud so as to have the shape of the flame that is typically associated with the use of an afterburner on a jet engine. The light system 76 produces light that is projected onto the steam cloud produced by the steam cloud system 72 and air amplifier 74. Typically, the color of the lights that are produced by the system 76 and projected onto the steam cloud are those colors associated with the use of an afterburner on a jet engine, namely, yellow, red, and blue. However, another color or colors can be projected onto the steam cloud, if needed or desired.

With continuing reference to FIGS. 1A, 1B, 2A-2C, and 3, the device 70 is described in greater detail. The housing 78 includes a cylinder 82 with a side wall 84 and a rear wall 86. The side wall 84 has a front edge 88 that defines an opening 90. A U-shaped bracket 92 is operatively engaged to the side wall 84 of the cylinder 82. The cylinder 82 supports an interior platform 94. The interior platform 94 supports a sintered nozzle 96 that receives steam from a steam conduit or pipe 97. The steam conduit 97 is supported by the bracket 92 and the interior platform 94. The sintered nozzle 96 is a solid, sponge-like structure that, in operation, disperses steam through a large number of small orifices and thereby produces a dispersed cloud of steam. Further, the operation of the sintered nozzle 96 is relatively quiet compared to a conventional single-orifice nozzle or comparable nozzle. The sintered nozzle 96 is located within a space defined by an open-ended cylinder 98. The open-ended cylinder serves to shape or linearize the steam cloud in a manner that facilitates the production of a simulated flame similar to the flame associated with an afterburner of a jet or a blowtorch.

The air amplifier 74 includes a housing 102 with generally cylindrical exterior surface 104, a first end 105A, a second end 105B, and an interior surface 106 that defines a horn-shaped interior space 108 that extends from the first end 105A to the second end 105B. The air amplifier 74 also includes a port 110 for receiving compressed air provided by the compressed air conduit 112. The exterior of the open-ended cylinder 98 and the interior surface 106 of the amplifier 74 define a space 114. The interior platform 94 defines multiple holes 116 that are located between the interior surface 106 of the amplifier 74 and the exterior surface of the cylinder 98. As such, there are passageways for air to move from a space 118 (that is located adjacent to the side of the interior platform 94 that is opposite to the side of the interior platform 94 adjacent to which the amplifier 94 is located) into the space 114. In operation, the application of compressed air to the amplifier 74 produces a vortex that, in turn, creates a vacuum that (depending on the extent of the vacuum) is capable of drawing substantial amounts of air from the space 118 into the space 114 and causing this air to move through the interior space 106 so as to produce a relatively high-velocity and substantially linear flow of air extending away from the second end 105B of the amplifier housing 102. More specifically, air amplifiers exploit what is known as the Coanda effect to produce a high velocity stream of air. This high velocity air stream creates a vacuum that pulls steam out of the interior of the cylinder 98 and entrains the steam in the high-velocity air stream with a linear characteristic that has the shape of an afterburner flame, i.e. a cylindrical shape or steep-side cone shape. It should be appreciated that the air amplifier 74 is also capable of producing a relatively low-velocity air stream that, in interacting with the steam cloud produced by the sintered nozzle 96, produce a steam cloud that has a shape that resembles the shape of flame produced by a candle or torch. Relatedly, the device 70 can be scaled down to be used to produce a torch, sconce, or similar device with a simulated flame.

The interior platform 94 supports a bank of high-intensity LED lights 122 that produce light of the desired color or colors and projects this light onto the steam cloud produced by the operation of the system 72 and the air amplifier 74 and extending away from the opening 90. The U-shaped bracket 92 supports a bank of LED lights 124 that produce light of a desired color or colors. The lights 124 are positioned to project light through the holes 116 defined by the interior platform 94 and onto the steam cloud produced by the operation of the system 72 and the air amplifier 74.

In operation, the device 70 is operated so as to produce a steam cloud within the cylinder 98 by the conveyance of steam to the sintered nozzle 96 by the steam conduit 97. The compressed air conduit 112 is used to apply compressed air to the air amplifier 74. In response, the air amplifier 74 produces a high-velocity stream of air that moves substantially linearly away from the opening 90. This stream of air entrains steam from the steam cloud so as to produce a steam cloud with a shape that resembles the shape of the flame produced upon the application of an afterburner to a jet engine. The bank of LED lights 122 and bank of LED lights 124 produce the light with the appropriate color or colors for the simulated flame and direct the light onto the steam cloud produced by the operation of the steam cloud system 72 and the air amplifier 74.

With reference to FIGS. 4A, 4B, 5A-5C and 6-9, a second embodiment of a special effect device for producing a simulated afterburner flame effect, hereinafter device 130, is described. Generally, the device 130 differs from the device 70 in the mechanism that is employed as a steam accelerator. In the device 70, the air amplifier 74 is primarily responsible for providing a high-speed stream of air that is used to accelerate the steam cloud produced adjacent to the sintered nozzle 96 to create a highly linear steam cloud that can be used to achieve the simulated afterburner flame effect. In contrast, the device 130 employs a nozzle that exploits the Venturi effect to produce a high-speed stream of air that is applied to the stream of steam or steam cloud provided at the outlet of the pipe or conduit that carries the steam.

Generally, the device 130 includes a steam system 132 for providing a stream or cloud of steam, a nozzle 134 for producing a high-velocity and substantially linear flow of air and applying this flow of air to the steam provided by the steam system 132, a lighting system 136 for producing light that is directed onto a linearly extending steam cloud produced by the operation of the steam system 132 and the nozzle 134 so that the resulting simulated flame has the color or colors of an actual flame, and a support structure 138 for supporting and housing the steam system 132, nozzle 134, and lighting system 136. In operation, the steam system 132 provides stream of steam to the nozzle 134. In turn, the nozzle 134 operates so as to produce a high-speed and substantially linear stream of air that is applied to the steam to achieve a steam cloud that has the shape of the flame that is typically associated with the use of an afterburner on a jet engine. The light system 136 produces light that is projected onto the steam cloud produced by the operation of the steam system 132 and the nozzle 134. Typically, the color of the lights that are produced by the light system 136 and projected onto the steam cloud are those colors associated with the use of an afterburner on a jet engine, namely, yellow, red, and blue. However, another color or colors can be projected onto the steam cloud if needed or desired.

With continuing reference to FIGS. 4A, 4B, 5A-5C and 6-9, the device 130 is described in greater detail. The support structure 138 includes a frame 140 that supports a cylinder 142 that houses the nozzle 134 and lighting system 136. The cylinder 142 can be pivoted relative to the frame 140 so as to adjust the direction of the afterburner flame produced when the device 130 is in operation. The frame 140 also supports control and power circuitry 144 used by the device 130. The cylinder 142 has a side wall 146 and a rear wall 148. The cylinder 142 has a front edge 150 that defines an opening 152. The cylinder 142 supports an interior platform 154 that, in turn, supports the steam system 132, nozzle 134, and lighting system 136.

The steam system 132 includes a piping structure 157 for conveying a stream of steam between a boiler (not shown) and the nozzle 134. The piping structure 157 includes a valve 158 that is used to control the flow of steam and the extent of the steam flow from the boiler to the remainder of the piping structure. In this regard, increasing the extent of the steam flow increases the length of the steam cloud that is used to simulate an afterburner flame. The piping structure 157 also includes a solenoid valve 160 that is used to control (start/stop) the flow of the stream of steam applied to the nozzle 134 via pipe 162. Further, the steam system 132 includes a steam separator 164 that removes water resulting from steam condensation within the steam system 132. The steam separator 164 includes a pipe with an orifice plate 166 and a check valve 168 that allows fluid received from the pipe 166 to be removed from the steam system 132 but prevents any fluid or air from flowing towards the pipe 166. Other types of steam separators are feasible.

With particular reference to FIG. 9, the nozzle 134 is described. The nozzle 134 includes an inlet port 172 that receives steam from the steam system 132, a splitter section 174 that disperses the steam received from the steam system 132 into multiple ports 176, an output section 178 that includes multiple ports 180 each of which is aligned with, but separated by a gap 182 from, one of the multiple ports 176 of the splitter section 174 so as to receive steam from each of the multiple ports 176 and air drawn in via the gap 18. Generally, the ejection of steam across the gap 182 creates a vacuum that pulls in air adjacent to the gap and accelerates the steam that is dispensed from the output 178 of the nozzle 134. The nozzle 134 is generally marketed as a steam sparger that is used to used to inject steam into a fluid (e.g., water) to heat the fluid. In this case, the steam sparger is being used as a steam accelerator to produce a high-speed air stream that is applied to a stream of steam to accelerate the stream of steam and thereby create a steam cloud with the desired shape for creating a simulated afterburner flame effect. It is believed that steam spargers that have a single port, i.e., do not split an input stream of steam into multiple ports, can be used. Further, it is also believed that other types of devices that exploit the Venturi effect can be used as a steam accelerator. The nozzle 134 is located within a space defined by an open-ended cylinder 184. The open-ended cylinder 184 is believed to make some contribution to shaping or linearizing the steam cloud but not to the extent that the nozzle 134 contributes. There are holes 186 located between the point at which the edge of cylinder 184 contacts the interior platform 154 and the nozzle 134 that allow air to be drawn from the space on the opposite side of the interior platform 154 from the side adjacent to which the cylinder 184 is located. An example of the nozzle 134 is the MS-6 noiseless heater produced by Armstrong International Inc.

The lighting system 136 includes a bank of high-intensity LED lights 190 that produce light of the desired color or colors and projects this light onto the steam cloud produced by the operation of the steam system 132 and the nozzle 134 that extends away from the opening 152.

In operation, the steam system 132 is used to provide a stream of steam to the nozzle 134. In response, the nozzle 134 operates to accelerate the stream of steam so as to produce a steam cloud that extends away from the opening 152 and has a highly linear character and a shape comparable to that of a jet afterburner. One of more of the lights in the bank of high-intensity LED lights 190 is used to produce light that is projected onto the steam cloud so that the steam cloud appears to have not only the shape of an afterburner flame but also the color or colors of an afterburner flame. Typically, the colors projected onto the steam cloud are blue, yellow, red, and/or orange. However, other colors can be projected onto the steam cloud if needed or desired.

With reference to FIGS. 10, 11A-11C, 12, and 13A-13B, a third embodiment of a special effect device for producing a simulated afterburner flame effect, hereinafter device 200 is described. Generally, the device 200 differs from devices 70 and 130 in the mechanism that is employed as a steam accelerator. In device 70, the air amplifier 74 is primarily responsible for providing a high-speed stream of air that is used to accelerate the steam cloud produced adjacent to the sintered nozzle 96 so as to create a highly linear steam cloud that can be used to achieve the simulated afterburner flame effect. In device 130, the nozzle 134 is primarily responsible for providing a high-speed stream of air that is used to accelerate the stream of steam or steam cloud provided at the outlet of the steam system 132. In the device 200, a steam accelerator is employed that includes both (a) a nozzle that exploits the Venturi effect to accelerate the stream of steam, like nozzle 134, and (b) an air amplifier that uses the Coanda effect to generate a high-speed stream of air, like air amplifier 74. Generally, the high-speed stream of air produced by the air amplifier serves to produce a "cage" around the high-speed steam cloud produced by the nozzle to keep the steam cloud from spreading or billowing, which becomes an increasingly more significant issue as the length of the steam cloud that is meant to simulate the shape of an afterburner flame increases. However, the high-speed stream of air produced by the air amplifier is also believed to contribute to creating the highly linear steam cloud.

Generally, the device 130 includes a steam system 202 for providing a stream or cloud of steam, a nozzle 204 for producing a high-velocity and substantially linear flow of air and applying this flow of air to the steam provided by the steam system 202, an air amplifier 206 for producing a high velocity, linear flow of air that is applied to the steam cloud produced adjacent to the nozzle 204, a lighting system 208 for producing light that is directed onto a linearly extending steam cloud produced by the operation of the steam system 202, the nozzle 204, and the air amplifier 206 so that the resulting simulated flame has the color or colors of an actual flame, and a support structure 210 for supporting and housing the steam system 202, nozzle 204, air amplifier 206, and lighting system 208. In operation, the steam system 202 provides steam to the nozzle 204. In turn, the nozzle 204 operates so as to produce a high-speed and substantially linear stream of air that is applied to the steam to achieve a steam cloud that has the shape of the flame that is typically associated with the use of an afterburner on a jet engine. The air amplifier 206 also produces a high-speed and substantially linear stream of air that is applied to the steam cloud produced adjacent to the nozzle. The light system 208 produces light that is projected onto the steam cloud produced by the operation of the steam system 202, nozzle 204, and air amplifier 206. Typically, the color of the lights that are produced by the light system 208 and projected onto the steam cloud are those colors associated with the use of an afterburner on a jet engine, namely, yellow, red, and blue. However, another color or colors can be projected onto the steam cloud if needed or desired.

With continuing reference to FIGS. 10, 11A-11C, and 12-14, the device 200 is described in greater detail. The support structure 210 includes a frame 212 that supports a cylinder 214 that houses the nozzle 204, air amplifier 206, and lighting system 208. The cylinder 214 can be pivoted relative to the frame 212 so as to adjust the direction of the afterburner flame produced when the device 200 is in operation. The frame 212 also supports control and power circuitry 216 used by the device 200. The cylinder 214 has a side wall 218 and a rear wall 220. The cylinder 214 has a front edge 222 that defines an opening 224. The cylinder 214 supports an interior platform 226 that, in turn, supports the steam system 202, nozzle 204, air amplifier 206, and lighting system 208.

The steam system 202 includes a piping structure 203 for conveying steam between a boiler (not shown) and the nozzle 204. The piping structure 203 includes a valve 230 that is used to control the flow of steam and the extent of the steam flow from the boiler to the remainder of the piping structure. In this regard, increasing the extent of the steam flow increases the length of the steam cloud that is used to simulate an afterburner flame. The piping structure 203 also includes a solenoid valve 232 that is used to control (start/stop) the flow of the stream of steam applied to the nozzle 134 via pipe 162. Further, the steam system 202 includes a steam separator 236 that removes water resulting from steam condensation within the steam system 202. The steam separator 236 includes a pipe with an orifice plate 238 and a check valve 240 that allows fluid received from the pipe 238 to be removed from the steam system 202 but prevents any fluid flow towards the pipe 238. Other types of steam separators are feasible.

The nozzle 204 is substantially identical to nozzle 134. As such, the structure and operation of nozzle 204 will not be described further. Additionally, the air amplifier 206 is substantially identical to air amplifier 74. As such, the structure and operation of air amplifier 206 will not be described further. A pneumatic system 244 is used to control the flow (start/stop) of compressed air from a compressor (not shown) applied to the air amplifier 206. The nozzle 204 is located on the longitudinal axis defined by the cylindrical exterior surface of the air amplifier 206. As such, the stream of high-velocity air produced by the air amplifier 206 will surround the linear flowing steam cloud produced by the nozzle 134 and serve to prevent the steam cloud from billowing. In addition, the high-velocity stream of air produced by the air amplifier is also believed to contribute to the linear nature of the steam cloud extending away from the nozzle 134. The nozzle 204 elsewhere, including off the longitudinal axis and at different locations along the longitudinal axis provided the steam cloud produced by the nozzle 204 is within the footprint of the air flow produced by the air amplifier 206. There are one or more holes 246 located between the point at which the edge of air amplifier 206 contacts the interior platform 226 and the conduit/pipe 234 that allow air to be drawn by both the nozzle 204 and air amplifier 206 from the space on the opposite side of the interior platform 226 from the side that is immediately adjacent to the air amplifier.

The lighting system 208 includes a bank of high-intensity LED lights 250 that produce light of the desired color or colors and project this light onto the steam cloud produced by the operation of the steam system 202, nozzle 204, and air amplifier 206 that extends away from the opening 224.

In operation, the steam system 202 is used to provide a stream of steam to the nozzle 134. In response, the nozzle 204 operates to accelerate the stream of steam so as to produce a steam cloud that extends away from the opening 224 and has a highly linear character and a shape comparable to that of the flame produced by a jet afterburner. The air amplifier 206 operates to prevent the steam cloud produced by the nozzle 204 from billowing and, as such, can facilitate the production of a relatively long steam cloud. One of more the lights in the bank of high-intensity LED lights 250 is used to produce light that is projected onto the steam cloud so that the steam cloud appears to have not only the shape but the color or colors of a jet afterburner. Typically, the colors projected onto the steam cloud are blue, yellow, red, and/or orange. However, other colors can be projected onto the steam cloud if needed or desired.

The foregoing description of the invention is intended to explain the best mode known of practicing the invention and to enable others skilled in the art to utilize the invention in various embodiments and with the various modifications required by their particular applications or uses of the invention.

What is claimed is:

1. A special effect device for use in creating a simulated afterburner flame effect, the device comprising:

a pipe for conveying a stream of steam from a first terminal end of the pipe to a second terminal end of the pipe;

a steam accelerator, disposed adjacent to the second terminal end of the pipe, for causing an output stream of steam ejected from the second terminal end of the pipe to be formed into a steam cloud with a linear columnar shape extending away from the second terminal end of the pipe; and a lighting structure adapted to project light onto a steam cloud with a linear columnar shape and extending away from the second terminal end of the pipe so as to create an illusion of an afterburner-shaped flame; and wherein the steam accelerator comprises a nozzle that employs the Venturi effect to produce a first high-speed stream of air and an air amplifier that employs the Coanda effect to produce a second high-speed stream of air, the first and second high-speed streams of air being applied to a stream of steam to generate the steam cloud with the linear columnar shape.

2. A special effect device, as claimed in claim 1, wherein:

the air amplifier has a tubular shape that defines a first open end, a second open end that is separated from the first open end, and an interior space located between the first and second open ends;

wherein the nozzle is located within the interior space defined by the air amplifier.

3. A special effect device, as claimed in claim 1, further comprising: a sintered nozzle connected to the second terminal end of the pipe.

4. A special effect device, as claimed in claim 3, wherein:

the air amplifier is disposed adjacent to the sintered nozzle.

5. A special effect device, as claimed in claim 1, further comprising: a steam separator for removing condensation from the pipe.

6. A special effect device for use in creating a simulated afterburner flame effect, the device comprising:

a pipe for conveying a stream of steam from a first terminal end of the pipe to a second terminal end of the pipe, and the pipe configured to eject an output of a linear flowing stream of steam in a direction defined by a longitudinal axis;

a steam accelerator disposed adjacent to the second terminal end of the pipe, the steam accelerator configured to produce a stream of air in a direction parallel to, and in a surrounding configuration with, the longitudinal axis of the output stream of the linear flowing steam ejected from the second terminal end of the pipe, the steam accelerator defining the stream of air with a given width, and the steam accelerator combining the stream of air with the output stream of the linear flowing steam so as to form a steam cloud with a linear columnar shape having a width defined by the given width of the stream of air, and the steam cloud extending away from the second terminal end of the pipe; and a lighting structure adapted to project light onto a steam cloud with a linear columnar shape and extending away from the second terminal end of the pipe so as to create an illusion of an afterburner-shaped flame.

7. A special effect device, as claimed in claim 6, wherein:

the steam accelerator comprises a nozzle adapted to receive the output stream of the linear flowing steam from the second terminal end of the pipe and use the Venturi effect to produce the stream of air surrounding the output stream of the linear flowing steam so as to produce the steam cloud with the linear columnar shape.

8. A special effect device, as claimed in claim 6, wherein:

the steam accelerator comprises an air amplifier adapted to receive the stream of the linear flowing steam from the second terminal end of the pipe and use the Coanda effect to produce the stream of air surrounding the output stream of the linear flowing steam to produce the steam cloud with the linear columnar shape.

9. A special effect device, as claimed in claim 6, further comprising: a sintered nozzle connected to the second terminal end of the pipe.

10. A special effect device, as claimed in claim 9, wherein:

the steam accelerator comprise an air amplifier disposed adjacent to the sintered nozzle.

11. A special effect device, as claimed in claim 6, further comprising a steam separator for removing condensation from the pipe.

12. A special effect device for use in creating a simulated afterburner flame effect, the device comprising:

a pipe for conveying a stream of steam from a first terminal end of the pipe to a second terminal end of the pipe;

a steam accelerator including a steam sparger disposed adjacent to the second terminal end of the pipe, the steam sparger for causing an output stream of steam ejected from the second terminal end of the pipe to be formed into a steam cloud with a linear columnar shape extending away from the second terminal end of the pipe; and a lighting structure adapted to project light onto a steam cloud with a linear columnar shape and extending away from the second terminal end of the pipe so as to create an illusion of an afterburner-shaped flame.

13. A special effect device, as claimed in claim 12, further comprising a steam separator for removing condensation from the pipe.

* * * * *